US005202532A

United States Patent [19]

Haglund et al.

[11] Patent Number: 5,202,532

[45] Date of Patent: Apr. 13, 1993

[54] AUTONOMOUS ACOUSTIC DETONATION DEVICE

[75] Inventors: Steven A. Haglund; Dennis L. Kurschner, both of Minnetonka; Kenneth W. Paulson, Eden Prairie, all of Minn.

[73] Assignee: Alliant Techsystems Inc., Edina, Minn.

[21] Appl. No.: 747,393

[22] Filed: Aug. 16, 1991

Related U.S. Application Data

[63] Continuation of Ser. No. 525,929, May 21, 1990, abandoned.

[51] Int. Cl.[5] ..... F42D 1/055

[52] U.S. Cl. ..... 102/217; 102/220; 102/215

[58] Field of Search ..... 102/214, 211, 217, 215, 102/218, 220, 206, 200, 202.1

[56] References Cited

U.S. PATENT DOCUMENTS

| | | | |
|---|---|---|---|
| 2,413,296 | 12/1946 | Deal et al. | 102/214 |
| 3,741,124 | 6/1973 | Visk | 102/220 |
| 3,780,654 | 12/1973 | Shimizu et al. | 102/312 |
| 3,987,729 | 10/1976 | Andrews et al. | 102/210 |
| 4,037,538 | 7/1977 | Andrews et al. | 102/210 |
| 4,085,679 | 4/1978 | Webb et al. | 310/11 |
| 4,478,149 | 10/1984 | Backstein et al. | 102/215 |
| 4,615,268 | 10/1986 | Nakano et al. | 102/200 |
| 4,760,791 | 8/1988 | Bock | 102/217 |

FOREIGN PATENT DOCUMENTS

| | | | |
|---|---|---|---|
| 204367 | 12/1986 | European Pat. Off. | 102/214 |

OTHER PUBLICATIONS

M-1 Concussion Detonator Information Sheet (date unknown).

*Primary Examiner*—Stephen M. Johnson

*Attorney, Agent, or Firm*—Merchant, Gould, Smith, Edell, Welter & Schmidt

[57] ABSTRACT

An autonomous detonation device comprising an acoustic sensor, a logic circuit, and an output circuit. The invention is capable of discriminating the acoustic signal of an explosion of a primary charge such that it will detonate an explosive shortly thereafter. The invention further incorporates a delay system for safety purposes.

19 Claims, 4 Drawing Sheets

AUTONOMOUS ACOUSTIC DETONATION DEVICE

The Government has rights in this invention pursuant to Contract No. 87-I-211410.

This is a continuation, of application Ser. No. 07,525,929, filed May 21, 1990, which was abandoned upon the filing hereof.

FIELD OF THE INVENTION

The present invention pertains to demolition and particularly detonators. More particularly, the invention pertains to the simultaneous detonation of a plurality of explosives.

BACKGROUND OF THE INVENTION

In some situations during the course of commercial and military demolition operations, it is imperative to have substantially simultaneous detonation of several explosive charges which are not in close proximity to each other. Further, it is desirable that these devices do not require any physical connections between them, that they need not require line of sight location, nor that magnetic waves interfere with their operation. This allows the operator to place the charges faster and conceal them better, thereby reducing the possibility of enemy detection.

In the past, if an operator wished to destroy a subject (e.g., a bridge), the operator would distribute charges throughout the supporting members of the bridge. These charges would then be connected with a detonation cord or wire which would be strung from one charge to another. The detonation cord and wire had two negative characteristics. The first was that it took time to string the cord or wire. This forced the operator to spend an inordinate amount of time stringing the cord or wire; the operator was thereby less efficient and exposed to possible detection by unfriendly forces for a greater time period. The second detrimental characteristic was the detection of the detonation cord or wire; as the cord or wire was strung from one charge to another, it was difficult to conceal. Thus detection of the explosive before detonation became quite probable in military operations.

A second method of detonating devices includes remote blasting systems. An example of this method is in U.S. Pat. No. 4,615,268. This method uses an electromagnetic wave to induce AC currents in the receiving unit. Upon receiving the electromagnetic wave, the receiving unit detonates a blasting cap which in turn detonates a charge. Although this method does not use detonation cord, it is susceptible to electromagnetic interferences. For instance, if the object the operator wished to remove was a radio tower, it was possible that the tower itself would interfere with the detonation method.

The U.S. Army has a device designated as the M1 Concussion Detonator. The M1 Concussion Detonator is a mechanical firing device actuated by the concussion wave of a nearby blast. It fires several charges simultaneously without connecting them with wire or detonating cord. A single charge detonated in water or air will detonate all charges primed with the concussion detonators within a particular range of the main charge or of each other. This device has two major drawbacks. The first is that it requires line of sight between each charge in order to operate. The second is that the maximum range in air is only 25.2 feet thus severely limiting the device. Another drawback is that the Ml is unable to discriminate between particular types of signals, as the Ml is dependent upon signal strength only.

This invention overcomes the problems of the prior art. This invention does not require physical connections between each of the charges, yet allows them to detonate substantially simultaneously. However, unlike the remote blasting system, this invention is not affected by electromagnetic waves. This invention operates by sensing the acoustic wave generated by the explosion of a primary charge. Further, it has a much larger range than the Ml and does not require a line of sight placement due to the characteristics of an acoustic signal. Further, unlike the Ml, this invention is capable of discriminating between different signals, thus lessening the chance of a false detonation.

SUMMARY

This invention overcomes the problems previously described in the background through use of an acoustic sensor. This invention is capable of being activated by two or more pounds of high explosives such as C4 explosive at a range of 150 feet. "C4" is a designated used by the Army to identify a particular explosive described in Military Specification MIL-C-45010A. Further, this invention does not require line of sight placement due to the characteristics of a low frequency acoustic signal. This invention comprises an acoustically sealed box containing an acoustic sensor means, a logic means and an output means. The acoustic sensor means comprises a microphone, a band pass filter and a detector. The microphone senses the acoustic signal generated by the detonation of a primary explosive and passes this signal to a band pass filter. The band pass filter then passes a predetermined frequency band to the detector. If the signal is of sufficient strength, the detector then passes the signal to the logic means. The logic means comprises a pair of oscillators, a pair of counters, a self check means and an output control. The power source can either be primary batteries such as carbon zinc or alkaline or can be a reserve battery where the electrolyte is stored in a glass ampule internal to the battery until it is broken at activations. When electrical power is applied to the electronics, both counters begin counting out the predetermined time from signals provided by the oscillators. The self check means determines whether both oscillators are operating at similar frequencies thereby increasing the safety of the invention. Upon both counter reaching the predetermined time and the self check means giving a positive signal to the output control, a signal from the detector may pass to the output means. This allows the operator a predetermined time from when he activates the invention, to the time that the detonator will actually operate. Further, the logic means has a second predetermined time counted by the counter, where upon the counter reaching the second predetermined time, passes a fire signal to the output means. This prevents a failure of the primary charge from preventing the device from eventually detonating.

The output means for this invention is common in this class of art and operates simply by applying the energy from the energy source to a blasting cap.

Line of sight location is not required for this invention due to the characteristics of a low frequency acoustic signal. A low frequency signal is able to travel around objects. It is therefore not necessary for physical connections between the devices as the acoustic sensor will sense the detonation of the primary explosive if it is located within a specific range. Further, electromagnetic waves will not affect the device, thus avoiding the major faults of the related art.

A DESCRIPTION OF THE PREFERRED EMBODIMENT

The development of the present invention, an acoustic detonation system, was in response to a need at the Engineers' School at Ft. Leonardwood, Missouri. The detonation system was designed to be activated by the detonation of 2 lbs. of C4 explosive at a distance of up to 150 feet. Secondly, it does not require a line of sight between the primary charge detonation and the system. Thirdly, the system is immune from false activation from the normal background environment. Fourth, since broadcast towers, radar, and microwave facilities are potential targets, the device can operate in high RF (Radio Frequency) environments.

Figure 1:
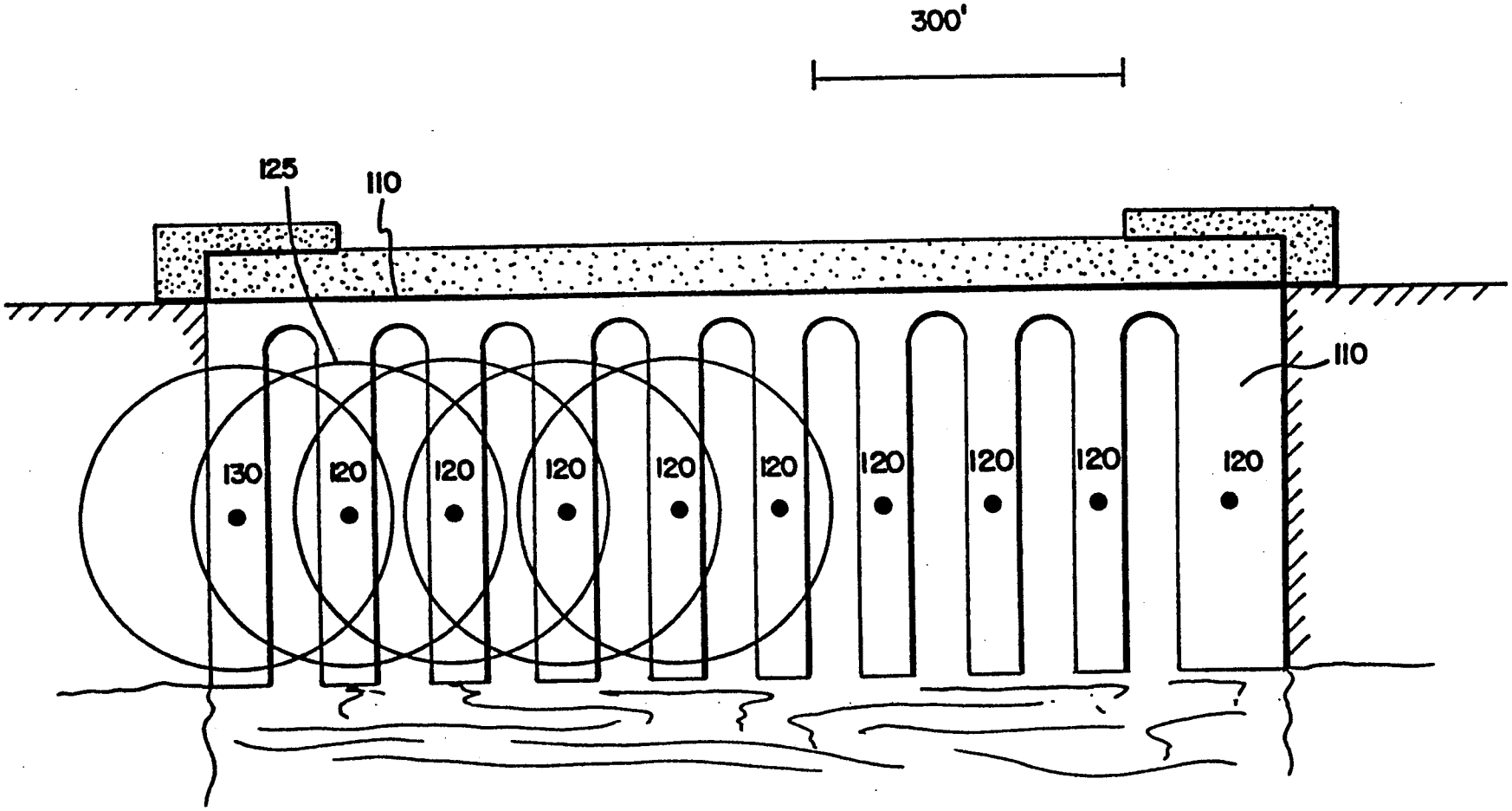
FIG. 1 demonstrates how a detonation device is utilized for the destruction of a bridge.

FIG. 1 demonstrates how the present invention may be utilized in the destruction of a bridge 110. Invention or autonomous detonation device 120 having at least 2 lbs. of the C4 explosive is placed on numerous supporting structures of the bridge 110, making sure that each device 120 is within the 300-foot diameter 125 of a second device 120. This insures that each device 120 will be detonated substantially simultaneously with explosion of a primary charge 130. A main primary charge 130 having at least 2 lbs. of the C4 explosive is located within the 300-foot diameter 125 of a second charge 120. Thus, upon the detonation of primary charge 130, all of the explosives on the bridge will be detonated either by the devices 120 sensing the initial primary explosion, or by sensing a secondary explosion within its 300-foot diameter or 150-foot range 125.

Embodiment 120 of the present invention was specifically designed to work with the explosive C4 as it is a standard explosive used by military demolition units. Particularly, it was designed to detonate upon sensing a minimum of 2 lbs. of C4 explosive being detonated within a 150 foot radius; however, device 120 may be used with other powerful explosives. It was found that powerful explosives upon detonation, have a specific acoustic frequency which can be detected. For a C4 that frequency range is between 0.2 hertz and 500 hertz having a specific acoustic threshold level which can be calculated from acoustic measurements of the C4 explosive when detonated.

Embodiment 120 was tested to ensure that it would properly discriminate between the C4 explosive and small arms fire, such as a 30–06 rifle or a 12-gauge shotgun at 30 and 100 feet respectively. Secondly, the invention was tested to insure that a medium caliber weapon such as 25 mm and 30 mm automatic cannons fired at 30 and 100 feet, respectively, and a large gun, (e.g., a 155 mm Howitzer), fired at a 130 feet would not induce a false detonation. Due to the different acoustic frequencies and the threshold levels, this invention is able to distinguish each of these noise signals. Because the C4 explosive has a low frequency acoustic signal upon detonation, line of sight location for device 120 detonation is not required. This is due to low frequency signals being able to traverse obstacles more effectively than high frequencies.

Figure 2:
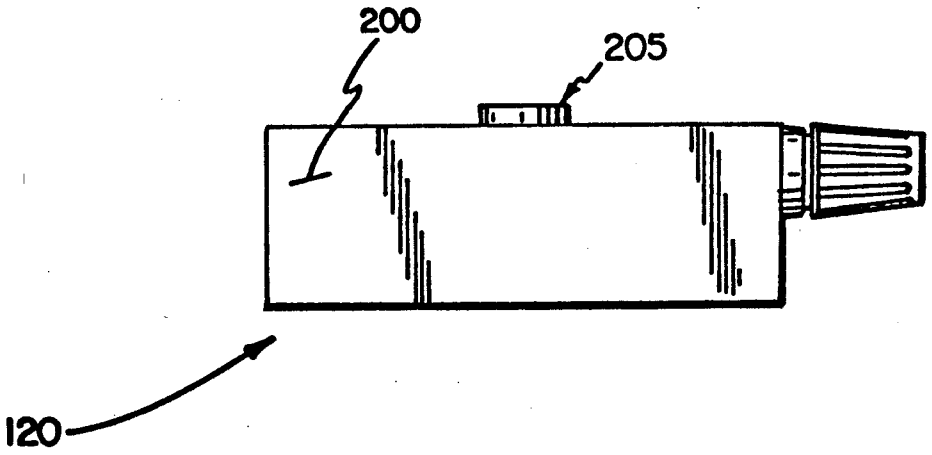
FIG. 2 is an embodiment of the invention.

FIG. 2 is a drawing of embodiment 120 the present invention as a finished product. The basic device is encased in an acoustically sealed box 200 with a microphone (not shown) located directly behind a sintered porous metal filter 205. Porous metal filter 205 functions as a barrier to the environment, for example, rain, dust, sand, insects and items that could damage the electronics. Further, metal filter 205 is an acoustic attenuator, attenuating the acoustic pressure wave created by the explosion of the primary charge. A Pacific Metals (located in Los Angeles, California) FCR-25 porous metal filter is used in this embodiment. The openings in the metal filter vary from 0.0005 to 0.001 inch.

By incorporating acoustically sealed box 200 and porous metal filter 205 (e.g., having the form of a metal diaphragm), seismic pressure waves are attenuated at a 10 to 1 level. Seismic pressure waves are signals that are passed through solid materials (e.g. the ground) and, unless attenuated, they may cause false detonation. Porous metal filter 205 diminishes the possibility of false detonation.

Acoustically sealed box 200 has been demonstrated to protect device 120 from damage due to a blast of as much as 10 lbs. of C4 within 20 feet. Thus, the sensor has the capability to survive and perform its primary function of detection, and has the feasibility of a reusable device for training purposes provided that the training unit is designed to utilize replaceable batteries.

Figure 3:
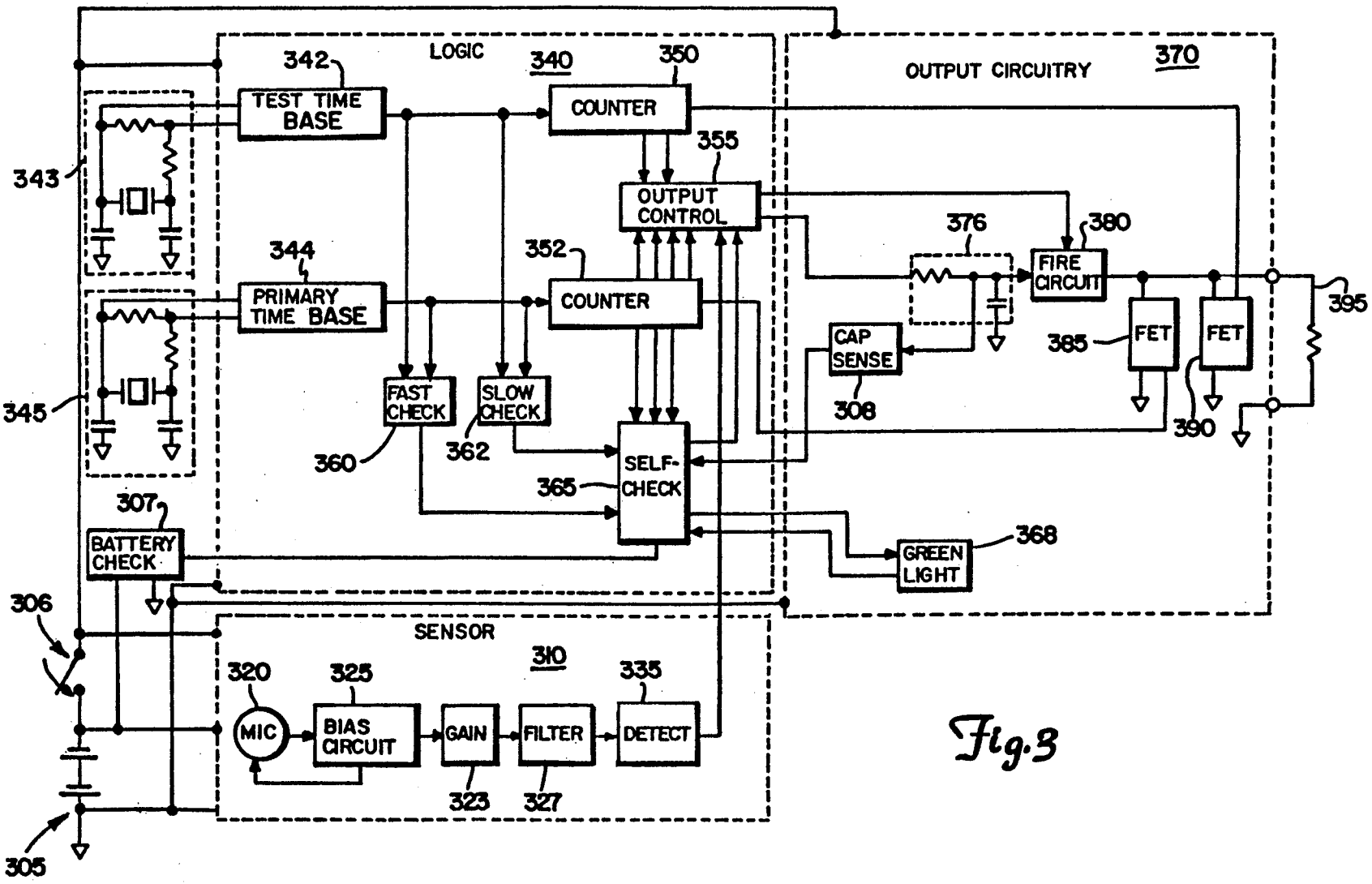
FIG. 3 is a schematic block diagram of the invention.

FIG. 3 is a schematic of the electrical components of the present invention. This schematic is divided into three major parts—a sensor means 310, a logic means 340 and an output circuit 370. Additionally, there is a blasting cap 395, two crystal oscillators 343 and 345, an energy supply 305, being two AA size batteries, and an initializing switch 306. The two AA size batteries 305 supply energy for the entire circuit used to detonate blasting cap 395.

The sensor circuit comprises a microphone 320, a bias circuit 325, a gain means 323, a filter 327, and a detection circuit 335. Microphone 320 is placed directly behind porous metal filter 205 of FIG. 2. Microphone 320 senses the initial explosion of the primary charge or a secondary charge. Upon sensing the detonation of the primary charge, microphone 320 passes a first signal to bias circuit 325. Bias circuit 325 provides feedback to microphone 320 in order to keep microphone 320 operating at its optimum level. Bias circuit 325 passes the signal from microphone 320 to gain circuit 323 and filter circuit 327. Gain circuit 323 increases the level of the signal sensed by microphone 320 to an adequate level which is usable by the remainder of the circuit. Filter 327 is a bandpass filter 327 which permits sound having a frequency from 0.2 hertz to 500 hertz to pass to detector 335. Detector 335, upon sensing the signal from filter 327, determines whether the signal is above a set threshold level. If the signal is above the set threshold, detector 335 continues to process the signal to output control 355 of logic means 340. Sensor circuit 310 is described in greater detail below in conjunction with FIG. 4.

Logic means 340 comprises an output control 355, two counters 350 and 352, two low power oscillators 342 and 344, a self-check 365, a slow-check 362 and a fast-check 360. Logic means 340 has two primary functions. First, logic means 340 passes the fire signal from sensor means 310 to output circuit 370. Second, logic means functions as a safety feature to prevent premature firing of blasting cap 395.

Logic means 340 is incorporated into a lSIC (large scale integrated circuit) in order to decrease the overall size and weight of the unit. In connection with the large scale integrated circuit, two crystal oscillators 343 and 345 have been provided. Upon initiation by initiating switch 306, crystal oscillators 343 and 345 oscillate and pass their signals to low power oscillators 342 and 344. First and second low power oscillators 342 and 344 are utilized to ensure that proper timing functions exist. First low power oscillator 344 is a primary time base. The output of primary time base 344 is provided to a first counter 352, slow-check means 362 and fast-check means 360. Second low power oscillator 342 is a test time base. The output of second low power oscillator 342 is provided to a second counter 350, slow-check 362 and fast-check means 360. First and second counters 350 and 352 are utilized to count out a first event time and a second event time. The first event time occurs approximately ten minutes after the initialization b switch 306. The first event time trigger prevents output control 355 from passing a fire signal from sensor means 310 to output circuit 370 until the 10 minute time period has elapsed. This first even time trigger is incorporated for the purposes of safety for the operator. Thus, by preventing the device from firing within the first ten minutes after initialization, the operator is able to place the entire system on the object to be destroyed and still have an adequate time to leave the area before the device is capable of detonating.

Counters 350 and 352 further count out a second event time. The second event time is several hours and upon the elapse of the second event time, output control 355 sends a fire signal to output circuit 370. The purpose of the second event time is to ensure that the device activates after a predetermined period of time in order to remove any explosives which may be harmful to friendly forces.

Further, logic means 340 incorporates a self-check means. The self-check means has a fast-check means 360, a slow-check means 362 and an overall self-check 365. Fast-check means 360 detects the output from both primary time base 344 and test time base 342. Fast-check means 360 compares both signals and determines whether either signal is oscillating at a unacceptably high level. Slow-check means 362 detects the signal from both primary time base 344 and test time base 342 and ensures that both signals are oscillating at an appropriate level. Outputs from both slow-check means 362 and fast-check means 360 are input into self-check 365. Self-check 365 receives signals from slow-check means 362, fast-check means 360, a battery check 307 and a capacitor sense 308. Battery check 307 ensures that the batteries 305 have a sufficient energy level. Capacitor sense 308 ensures that output circuit 370 is not energized prematurely. Upon receiving an adequate signal from battery check 307, capacitor sense 308, slow-check means 362 and fast-check means 360, self-check 365 passes a signal to output control 355 and thus allows output control 355 to pass the fire signal. Without the presence of a positive signal from self-check 365, output control 355 can not pass the fire signal. Further, upon receiving the signals from cap sense 308, battery check 307, slow-check means 362 and fast-check means 360, self-check 365 provides a signal to a light emitting diode 368 which informs the operator that the device passed the self-check. This occurs within the first few minutes after initiation by initiation switch 306.

As explained above, output control 355 provides the fire signal to output circuit 370. Further, output control 355 provides the supply voltage for output circuit 370 from battery 305. Output control 355 will provide a fire signal to output circuit 370 if one of two following conditions is met. The first condition is that a first event trigger has been received from both first and second counters 350 and 352, a positive self-check has been received from self-check 365 and a fire signal has been received from sensor means 310. The second condition is that a positive self-check has been received from self-check 365 and the second event trigger has been received from first and second counters 350 and 352.

Output circuit 370 of this device is common in the art. The output circuit comprises a transistor power switch 380 and an RC charging and energy storage circuit 376. Output control 355 provides power to a capacitor in filter 376 after the 10 minute first event time. Then output control 355 provides a fire signal to transistor switch 380. Energy from the capacitor in filter 376 is then passed through circuit 380 into blasting cap element 395 which detonates. Detonation of the blasting cap 395 causes the detonation of an explosive means, not shown in FIG. 3.

Another safety feature is imposed with FETS 385 and 390. A release signal from first counter 352 to first FET 385 (approximately 10 minutes after initialization of the device) must be received and a release signal from second counter 350 to second FET 390 must also be received. If these signals are not present, the system will not fire. This further protects the operator from a accidental firing.

Figure 4:
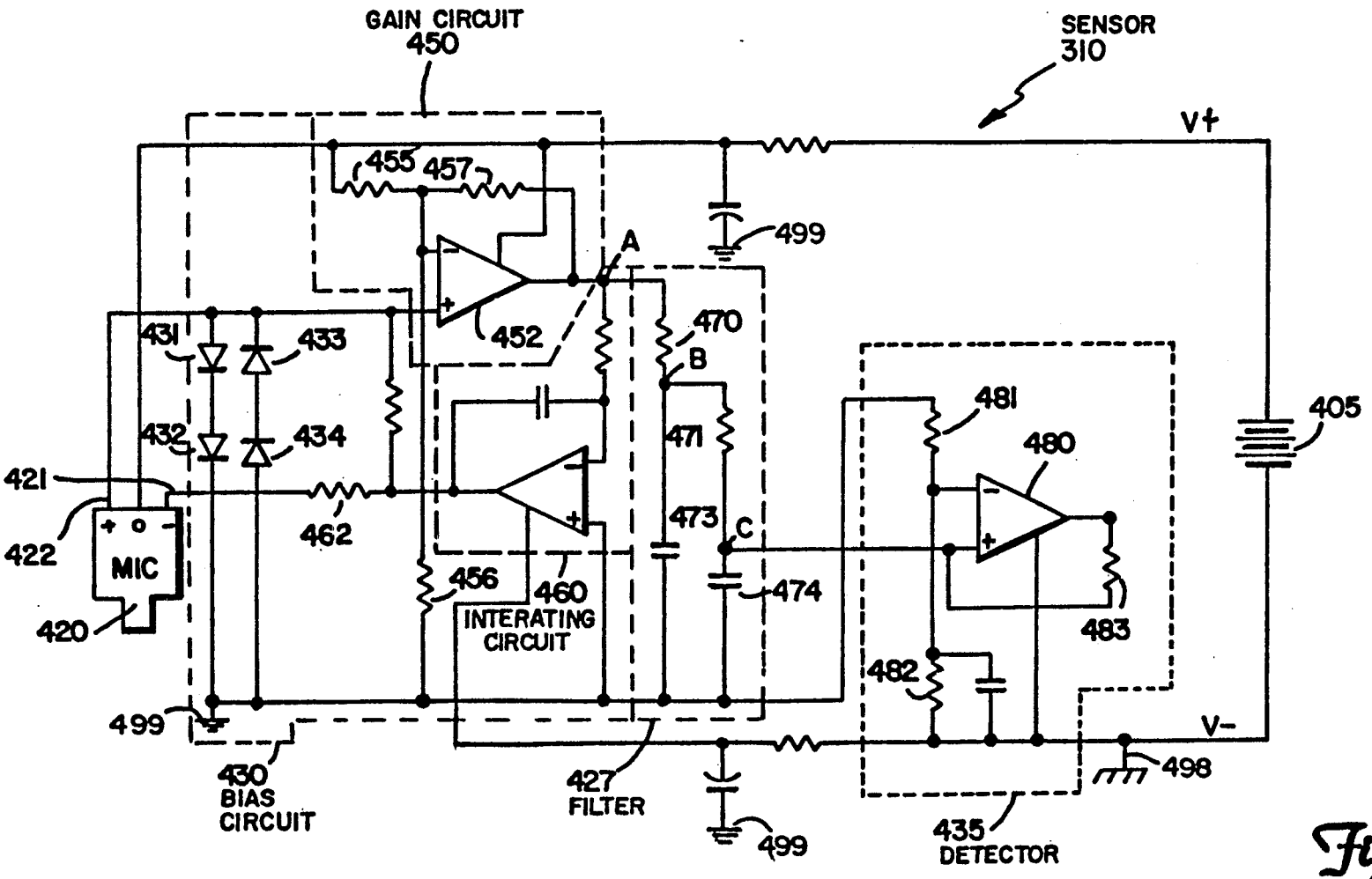
FIG. 4 is a schematic of the sensor means.

FIG. 4 is a more detailed schematic of the sensor means 310 shown in FIG. 3. Sensor means 310 comprises a microphone 420, a bias circuit 430, a filter 427, gain circuit 450, integrating circuit 460, and a detector means 435. Microphone 420 is a BL1785 microphone manufactured by Knowles Microphone Company (located in Franklin Park, IL). Microphone 420 receives a positive supply voltage from battery 405 and has both an input 421 and an output 422. Output 422 of microphone 420 is provided to gain and bias circuits 430 and 450.

Bias circuit 430 incorporates a voltage limiting circuit. The voltage limiting circuit is comprised of two pairs of IN4148 diodes 431, 432, 433 and 434, respectively. The first pair, 431 and 432, are electrically connected cathode-to-anode with the anode of first diode 431 connected to output 422 of microphone 420, the cathode of first diode 431 connected to the anode of second diode 432 and the cathode of second diode 432 connected to the case ground 499. As to the second diode pair, the cathode of first diode 433 is connected to output 422 of microphone 420, the anode of first diode 433 is connected to the cathode of second diode 434 and the anode of second diode 434 is connected to case ground 499.

Gain circuit 450 for sensor means 310 comprises a noninverting amplifier 452 with the positive input of operational amplifier 452 receiving a signal directly from the output of microphone 420. The negative input of operational amplifier 45 is electrically connected to a voltage divider. Resistors 455 and 456 are connected in series from the positive supply voltage to the negative supply voltage. The junction of resistors 455 and 456 is connected to the negative input of operational amplifier 452. Operational amplifier 452 further has a negative feedback resistor 457. The output of operational amplifier 452 is electrically provided to integrating amplifier 460 and passive bandpass filter 427. Integrating amplifier 460 is used as a feedback network to microphone 420. The output of integrating amplifier 460 is feed through resistor 462 back to microphone 420. This feedback provides the biasing noted above. Further, the output of integrating amplifier 460 is fed back to the positive input of noninverting amplifier 452, thereby reducing the DC offset and centering the output of noninverting amplifier 452.

Passive bandpass filter 427 comprises a network with terminals A, B and C and the circuit is made up of a pair of resistors 470 and 471 and a pair of capacitors 473 and 474. Resistor 470 is electrically connected between terminals A and B and second resistor 471 is electrically connected between terminals B and C. Capacitor 473 is electrically connected between terminals B and ground and second capacitor 474 is electrically connected between terminals C and ground. The input terminal for passive filter 427 is terminal A, which is connected to the output of noninverting amplifier 452. Terminal C, being the output of the passive filter 427, is input into detection means 435. Detection means 435 comprises a comparator amplifier 480 and resistors 481, 482 and 483. Resistor 483 is a hysteresis resistor, which is electrically connected between the positive input of comparator amplifier 480 and the output of comparator amplifier 480. The threshold level is set by connecting resistors 481 and 482 in series from case ground 499 to system ground 498. The junction of resistors 481 and 482 is connected to the negative input of comparator amplifier 480. In this manner, if the output of passive filter 427 is of sufficient strength, it will trigger comparator amplifier 480 to output a fire signal to logic means 340 of FIG. 3.

As has been shown, the present invention overcomes the limitations of the prior art. By incorporating the acoustic sensor, this device no longer requires the physical connections, such as detonation cord, and further is not susceptible to electromagnetic interference which affected prior art devices. Further, due to the specific characteristics of the acoustic signals of an explosive, the present invention is capable of discriminating normal background noises from the specific signal of the primary explosive. This enables the operator to quickly place the system on the object to be destroyed with a reduced chance of detection, thereby eliminating the dangers of prior art devices.

We claim:

1. An autonomous detonating device for detonating a blasting cap with use of a primary charge having a specific acoustic frequency band and a specific acoustic threshold level within a predetermined area when said primary charge is detonated, said device comprising:

(a) an acoustic sensor comprising a microphone, a bandpass filter and a detector, said microphone comprising means for sensing an explosion of said primary charge and for producing a first signal, said acoustic sensor further comprising conditioning means for receiving and conditioning said first signal and for applying said conditioned first signal to said bandpass filter, said bandpass filter comprising means for passing a portion of said conditioned first signal within said specific frequency band, thus forming a second signal, said second signal being provided to said detector, said detector comprising means for comparing said second signal to said specific acoustic threshold level and for producing a third signal as a function thereof; and (b) an output circuit comprising an energy source and a fire circuit adapted to be connected to said blasting cap, wherein said third signal is input into said fire circuit, said fire circuit comprising means for applying energy from said energy source to said blasting cap.

2. The apparatus of claim 1 wherein said conditioning means comprises bias means for providing feedback to said microphone, by providing a fourth signal to said microphone.

3. The apparatus of claim 2 wherein said bias means further comprises an output voltage limiter, wherein said output voltage limiter comprises a first, a second, a third and a fourth diode, the anode of said first diode being electrically connected to the cathode of said second diode, the cathode of said first diode being electrically connected to the output of said microphone, the anode of said second diode being electrically connected to ground, the anode of said third diode being electrically connected to the output of said microphone, the cathode of said third diode being electrically connected to the anode of said fourth diode, the cathode of said fourth diode being electrically connected to said ground.

4. The apparatus of claim 2 wherein said conditioning means further comprises gain means for increasing the level of said first signal, said gain means comprising a first and a second operational amplifier, said first operational amplifier being a noninverting operational amplifier, said second operational amplifier being an integrating amplifier, said first signal from said microphone being input into said noninverting amplifier, said noninverting amplifier providing a fifth signal, said fifth signal further being provided to said integrating amplifier, said integrating amplifier providing a sixth signal to said noninverting amplifier and to said microphone.

5. The apparatus of claim 1 wherein said bandpass filter further comprises a passive filter, said passive filter comprising a first and a second resistor and a first and a second capacitor, said passive filter being connected in an electrical network with terminals A, B and C, said first resistor being electrically connected between said terminals A and B, said second resistor being electrically connected between said terminals B and C, said first capacitor being electrically connected between said terminal B and ground, said second capacitor being electrically connected between said terminal C and said ground, said conditioned first signal being provided to said terminal A, said terminal C providing said second signal.

6. The apparatus of claim 5 wherein said detector comprises a third operational amplifier, said third operational amplifier being a comparator.

7. The apparatus of claim 1 further comprising logic means electrically located between said acoustic sensor and said output circuit for allowing passage of said third signal to said output circuit after a first predetermined time counted by a first counter of said logic means.

8. The apparatus of claim 7 further comprising a first oscillator for providing an oscillating signal to said first counter, said oscillator comprising means for beginning oscillating when an initiating switch is placed in an on position, said counter counting said oscillations.

9. The apparatus of claim 8 further comprising a second oscillator and wherein said logic means further comprises a second counter, said second oscillator comprising means for beginning oscillating with said first oscillator, said logic means comprising means for allowing passage of said third signal when both said first and said second counters count out said first predetermined time.

10. The apparatus of claim 9 wherein said first and second counters count a second predetermined time, said logic means comprising means for creating a fire signal substantially similar to said third signal and supplying it to said output circuit after said second predetermined time.

11. An autonomous detonation system for detonating a blasting cap with use of a primary charge having a specific acoustic frequency band and a specific acoustic threshold level within a predetermined area when said primary charge is detonated, said system comprising:

(a) an acoustic sensor comprising a microphone, a bandpass filter and a detector, said microphone comprising means for sensing an explosion of said primary charge and for producing a first signal, said acoustic sensor further comprising conditioning means for receiving and conditioning said first signal and for applying said conditioned first signal to said bandpass filter, said bandpass filter comprising means for passing a portion of said conditioned first signal within said specific frequency band, thus forming a second signal, said second signal being provided to said detector, said detector comprising means for comparing said second signal to said specific acoustic threshold level and for producing a third signal as a function thereof;

(b) an output circuit comprising an energy source and a fire circuit adapted to be connected to said blasting cap, wherein said third signal is input into said fire circuit, said fire circuit comprising means for applying energy from said energy source to said blasting cap; and (c) an explosive, wherein said blasting cap detonates said explosive upon said energy from said energy source being applied to said blasting cap.

12. The apparatus of claim 11 further characterized by said primary charge being C4 explosive.

13. The apparatus of claim 12 further characterized by said explosive being C4 explosive.

14. A detonation device for detonating a blasting cap with the use of a primary charge having a specific acoustic frequency band and a specific acoustic threshold level within a predetermined area when detonated, comprising:

sensing means for sensing an acoustic signal including at least an explosion of said primary charge and for generating a sensing means signal corresponding thereto;

control means for receiving said sensing means signal, for filtering said sensing means signal by passing a portion of said sensing means signal within said specific frequency band, and generating a fire signal as a function of said specific acoustic threshold level and said portion of said sensing means signal; and fire means coupled to said blasting cap for receiving said fire signal and for detonating said blasting cap.

15. A detonation device according to claim 14 wherein said sensing means comprises a microphone.

16. A detonation device according to claim 14 wherein said control means comprises:

conditioning means for receiving said sensing means signal, applying feedback to said microphone as a function thereof, and for providing gain for said sensing means signal, a conditioned signal resulting therefrom; and filter means for receiving said conditioned signal and for passing to a detector only that portion of said conditioned signal having a frequency within said specific frequency band, said detector comparing said portion of said conditioned signal to said specific acoustic threshold level and generating said fire signal if said threshold level is exceeded.

17. A detonation device according to claim 14 wherein said control means comprises:

pre-timer logic means for preventing said generation of said fire signal until a first predetermined time has expired after initiating said detonation device; and post-timer logic means for generating said fire signal after a second predetermined time has expired after initiating said detonation device, said post-timer logic means being prevented from generating said fire signal until after said first predetermined time has expired.

18. A detonation device according to claim 14 wherein said fire means comprises an energy source and a fire circuit coupled to said blasting cap, said fire circuit comprising means for receiving said fire signal and for applying energy from said energy source to said blasting cap for detonation thereof.

19. A detonation device according to claim 14 wherein said primary charge comprises a C4 explosive having a specific acoustic frequency band between approximately 0.2 hertz and approximately 500 hertz and having a particular specific acoustic threshold level within a particular predetermined area when detonated.

* * * * *

UNITED STATES PATENT AND TRADEMARK OFFICE

CERTIFICATE OF CORRECTION

PATENT NO. : 5,202,532

DATED : April 13, 1993

INVENTOR(S) : Haglund et al.

It is certified that error appears in the above-identified patent and that said Letters Patent is hereby corrected as shown below:

Col. 2, line 24, "designated" should read --designator--.

Col. 2, line 50, "counter" should read --counters--.

Col. 5, line 5, "lSIC" should read --LSIC--.

Col. 5, line 23, "b" should read --by--.

Col. 6, line 65, "45" should read --452--.

Signed and Sealed this

Thirteenth Day of September, 1994

Bruce Lehman

*Attest:*

BRUCE LEHMAN

*Attesting Officer*

*Commissioner of Patents and Trademarks*